United States Patent [19]

Sassa et al.

[11] Patent Number: 4,631,818

[45] Date of Patent: Dec. 30, 1986

[54] APPARATUS FOR APPLYING SLIDERS TO SEPARABLE SLIDE FASTENERS

[75] Inventors: Yuusei Sassa, Namerikawa; Keiichi Yoshieda, Kurobe, both of Japan

[73] Assignee: Yoshida Kogyo K. K., Tokyo, Japan

[21] Appl. No.: 767,640

[22] Filed: Aug. 20, 1985

[30] Foreign Application Priority Data

Sep. 26, 1984 [JP] Japan ..... 59-201037

[51] Int. Cl.[4] ..... A41H 37/06

[52] U.S. Cl. ..... 29/768; 29/766; 29/33.2

[58] Field of Search ..... 29/408–410, 29/766–770, 33.2

[56] References Cited

U.S. PATENT DOCUMENTS

| | | | |
|---|---|---|---|
| 3,874,057 | 4/1975 | Kawakami et al. | 29/768 |
| 4,131,993 | 1/1979 | Azzara | 29/768 |
| 4,457,062 | 7/1984 | Osaki | 29/766 |
| 4,570,335 | 2/1986 | Hatagishi | 29/768 |
| 4,573,264 | 3/1986 | Hatagishi | 29/768 |
| 4,580,326 | 4/1986 | Kawakami et al. | 29/408 |

FOREIGN PATENT DOCUMENTS 58-221903 12/1983 Japan .

*Primary Examiner*—Howard N. Goldberg
*Assistant Examiner*—Steven Nichols
*Attorney, Agent, or Firm*—Hill, Van Santen, Steadman & Simpson

[57] ABSTRACT

A slider applicator has a stopper attached to an end of a slide rod slidably mounted in a pivotable casing for movement parallel to a feed path along which a slide fastener chain is fed through a slider supported on a slider holder. When the stopper is displaced for a prescribed distance by box and insertion pins on the slide fastener chain, a microswitch is actuated to operate an air cylinder for angularly moving the casing to lift the casing out of engagement with the box and insertion pins, which are now allowed to move with the slide fastener chain past the stopper. In the event of improper positioning of one of the box and insertion pins, adjacent endmost coupling elements are jammed in a slider to thereby prevent the stopper from being displaced for the prescribed distance. A sensor switch is then actuated to signal such improper positioning of one of the box and insertion pins.

6 Claims, 12 Drawing Figures

APPARATUS FOR APPLYING SLIDERS TO SEPARABLE SLIDE FASTENERS

BACKGROUND OF THE INVENTION

1. Field of the Invention

The present invention relates to an apparatus for applying sliders to separable slide fasteners.

2. Description of the Prior Art

Japanese Laid-Open Patent Publication No. 58-221903 published on Dec. 23, 1983 discloses an automatic slider applicator for applying a slider to a separable slide fastener having a box pin and an insertion pin which are mounted respectively on the leading ends of slide fastener stringers. The revealed automatic slide fastener applicator includes an upstanding slider holder having a locking block and a stopper block which are vertically movably disposed in the slider holder. The stopper block has a vertical stopper on its upper end. The locking block has a spring-loaded slider locking lever on its upper end portion for locking a slider on the upper end of the stopper block. With the slider thus locked in position, the leading end of the slider is spaced from the vertical stopper on the stopper block. After the slider is locked, the box pin and the insertion pin are inserted through the slider until they are brought into abutment against the vertical stopper, whereupon the endmost coupling elements following the box and insertion pins are interengaged within the slider.

The coupling elements of the slide fastener stringers can properly be intermeshed in the slider only when the box and insertion pins are aligned on the stringer tapes, respectively. If one of the box and insertion pins is not properly positioned, then they are misaligned and the nearby endmost coupling elements are not allowed to be coupled in the slider. The endmost coupling elements are therefore jammed in the slider, resulting in a shutdown of the slide fastener finishing machine operatively coupled to the slider applicator. It has been time-consuming to find such a misalignment or improper positioning of the box and insertion pins because of a lot of manual labor involved, and troubles due to the misaligned pins have lowered the rate of production of separable slide fasteners.

SUMMARY OF THE INVENTION

It is an object of the present invention to provide an apparatus for applying sliders to separable slide fasteners, the apparatus having a sensor means for automatically detecting a misaligment or improper attachment of box and insertion pins on the slide fastener stringers.

According to the present invention, a slider applying apparatus or slider applicator includes a casing pivotably mounted on a support block and a slide rod slidably disposed in the casing. A stopper attached to an end of the slide rod has an end normally positioned in a feed path for engagement with box and insertion pins on a slide fastener chain fed along the feed path. The slide rod is connected to a damper disposed in the casing. When the stopper is displaced for a prescribed distance by the box and insertion pins, a switch means is actuated to operate an actuator means to angularly move the casing for lifting the stopper end out of the feed path, thus allowing the box and insertion pins to move past the stopper. In the event that one of the box and insertion pins is improperly positioned on the slide fastener chain, adjacent endmost coupling elements are not intermeshed in a slider supported on a slider holder adjacent to the stopper. The endmost coupling elements are therefore jammed in the slider, preventing the stopper from being displaced for the prescribed distance. A sensor means is now actuated to issue a signal indicating the improper positioning of one of the box and insertion pins.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION

Figure 1:
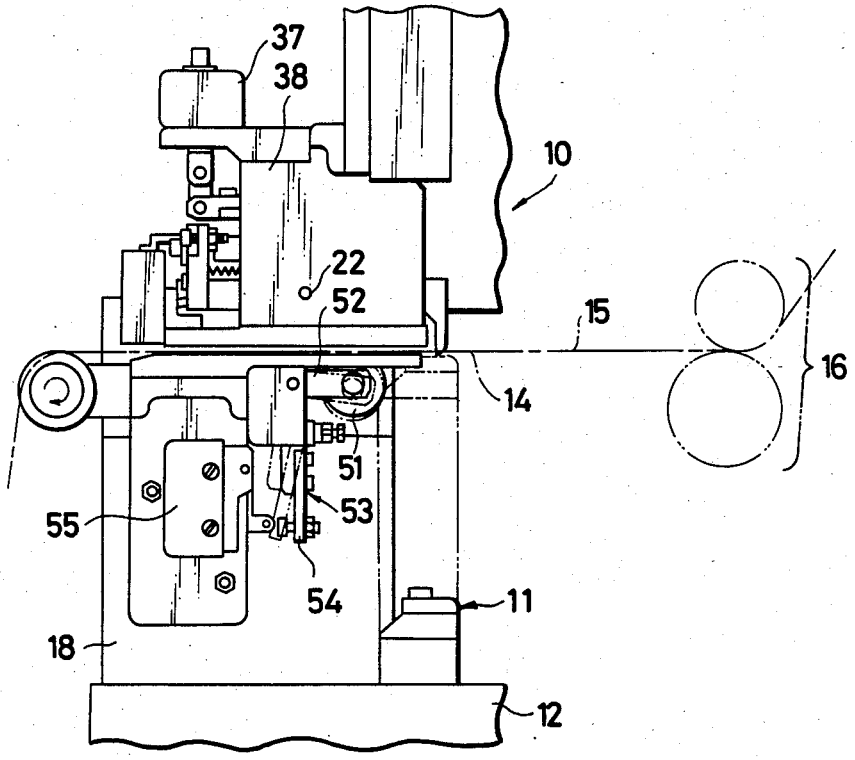
FIG. 1 is a side elevational view of a slider attachment machine.

The principles of the present invention are particularly useful when embodied in a slider applying apparatus or slider applicator such as shown in FIGS. 1 through 4, generally designated by the reference numeral 10.

As shown in FIG. 1, the slider applying apparatus 10 has a slider holder 11 mounted on a base 12 for supporting a slider 13 (FIG. 2) in a feed path 14 along which a slide fastener chain 15 is fed. The slide fastener chain 15 is fed along the feed path 14 by means of a feed roller assembly 16 located downstream of the slider applying apparatus 10 in the feed path 14.

Figure 2:
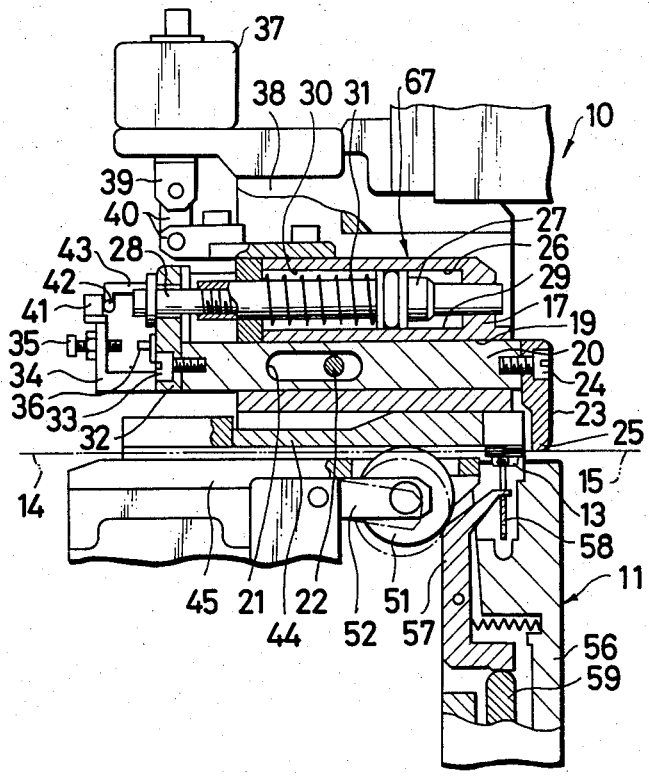
FIG. 2 is an enlarged side elevational view, partly in cross section, of a slider applying apparatus or slider applicator according to the present invention, incorporated in the slider attachment machine shown in FIG. 1.
Figure 3:
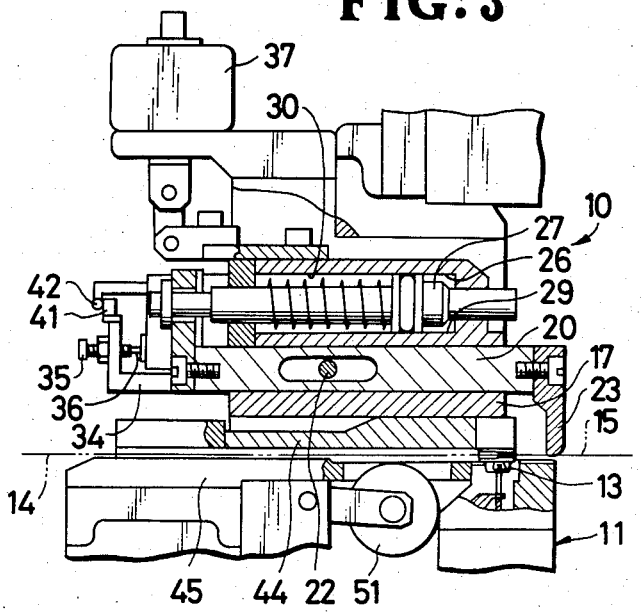
FIG. 3 is a view similar to FIG. 2, showing a stopper displaced by box and insertion pins attached properly to stringer tapes.

As illustrated in FIG. 2, the slider applying apparatus 10 includes a casing 17 pivotably mounted on a support block 18 (FIG. 1) disposed on the base 12, the casing 17 being positioned above the feed path 14. The casing 17 has a slot 19 defined therethrough and extending along the feed path 14 when the casing 17 is in the position of FIGS. 2 and 3. A slide rod 20 longitudinally slidably disposed in the slot 19 has a longitudinal oblong hole 21 through which extends a pin 22 fixed to an upper housing 38 fixed to the support block 18. A vertical stopper 23 is attached by a screw 24 to the front end of the slide rod 20. The vertical stopper 23 has a lower end 25 extending into the feed path 14 at a position behind the slider 13 supported on the slider holder 11 when the casing 17 is positioned as shown in FIGS. 2 and 3. The casing 17 is pivotably supported on the support block 18 such that the stopper 23 is vertically movable into and out of the feed path 14.

The casing 17 also has a cylinder bore 26 defined therein above the slot 19 and parallel thereto. A piston 27 is slidably disposed in the cylinder bore 26 and has its rear end connected to a connecting rod 28 projecting out of the cylinder bore 26 and the casing 17. The piston 27 divides the cylinder bore 26 into a first chamber 29 and a second chamber 30 which are supplied with air under pressure. The piston 27 is normally held in equilibrium or a state of balance within the cylinder bore 26 under the air pressure in the first chamber 29 and the resilient force of a spring 31 disposed in the second chamber 30. The rear ends of the slide rod 20 and the connecting rod 28 are interconnected by a bar 32 fastened by a screw 33 to the slide rod 20. The cylinder bore 26, the piston 27, and the spring 31 jointly serve as a damper 67 for dampening the movement of the slide rod 20.

An L-shaped arm 34 is fixed to the rear end of the slide rod 20 and supports a pusher 35 in the form of a screw mounted on the vertical member of the L-shaped arm 34. A microswitch 36 is mounted on the casing 17 in confronting relation to the pusher 35, so that the microswitch 36 can be actuated by the pusher 35 when the slide rod 20 is slidably moved in the slot 19 to the right (FIG. 2). The microswitch 36 is electrically connected to the solenoid of a solenoid-operated valve (not shown) coupled to an air cylinder 37 mounted on the upper housing 38 and accommodating the casing 17 therein. The air cylinder 37 has a piston rod 39 operatively connected by links 40 to the casing 17. When the microswitch 36 is energized, the air cylinder 37 is actuated to lower the piston rod 39 for tilting the casing 17 to lower the rear end of the slide rod 20 and raise the stopper 23.

The vertical member of the L-shaped arm 34 also supports on its upper end a sensing plate 41 having a prescribed width in the direction parallel to the feed path 14. A sensor switch 42 is mounted on an arm 43 fixed to and extending from the rear end of the casing 17. The sensor switch 42 may comprise a photoelectric sensor, a microswitch, or any other known detector. The sensor switch 42 is positioned alongside of the sensing plate 41 so that when the slide rod 20 is moved downstream to the right (FIGS. 2 and 3), the sensing plate 41 moves also to the right by and across the sensor switch 42. Where the sensor switch 42 comprises a photoelectric sensor, the sensing plate 41 moving by the sensor switch 42 cuts off a light beam emitted from a light source (not shown) toward the sensor switch 42. Where the sensor switch 42 comprises a mechanical microswitch, it is actuated by the sensing plate 41 moving thereby to the right. The sensor switch 42 issues a signal only when it is actuated by the sensing plate 41 for a period of time longer than a prescribed time interval, as described later on. The sensor switch 42 is electrically connected to a control circuit (not shown) for driving the feed roller assembly 16 and also to a pilot lamp (not shown).

Figure 5:
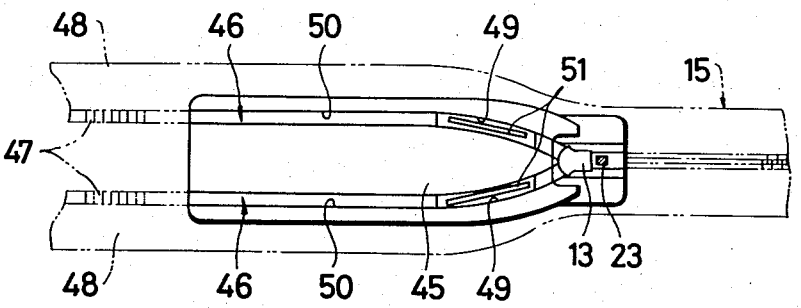
FIG. 5 is a plan view of a lower guide plate in the slider applicator.

An upper and a lower guide plate 44, 45 are fixed to the upper housing 38 and the support block 18, respectively, and are spaced vertically from each other in parallel relation to define part of the feed path 14 therebetween. As shown in FIG. 5, the lower guide plate 45 has a pair of guide grooves 46, 46 defined in the upper surface and opening upwardly for guiding the respective coupling element rows 47, 47 on slide fastener stringers 48, 48 of the slide fastener chain 15. The guide grooves 46, 46 include curved portions 49, 49 extending from their parallel straight portions 50, 50 and converging toward the Y-shaped guide channel in the slider 13 supported on the slider holder 11. A pair of sensor rollers 51, 51 is rotatably mounted on the horizontal arm 52 (FIG. 1) of an inverted L-shaped lever 53 pivotably supported on the support block 18. The sensor rollers 51, 51 are vertically movable into and out of the respective curved portions 49, 49 of the guide grooves 46, 46, and are normally urged to move upwardly by a resilient member (not shown) acting on the lever 53. The inverted L-shaped lever 53 includes a vertical arm 54 positioned near a microswitch 55 mounted on the support block 18. The microswitch 55 is electrically connected to an actuating mechanism (not shown) for vertically moving the slider holder 11 and the solenoid for actuating the air cylinder 37.

As illustrated in FIG. 2, the slider holder 11 includes a holder body 56 and a slider locking lever 57 pivotably supported in the holder body 56 for lockingly engaging the pull tab 58 of the slider 13 to lock the slider 13 on the slider holder 11. When the slider 13 is supported on the slider holder 11, the stopper 23 in its lowered position is located downstream of the leading end of the slider 13 in spaced relation therefrom. The slider holder 11 also includes a spindle rod 59 movable upwardly for turning the slider locking lever 57 to release the slider 13.

Figure 6:
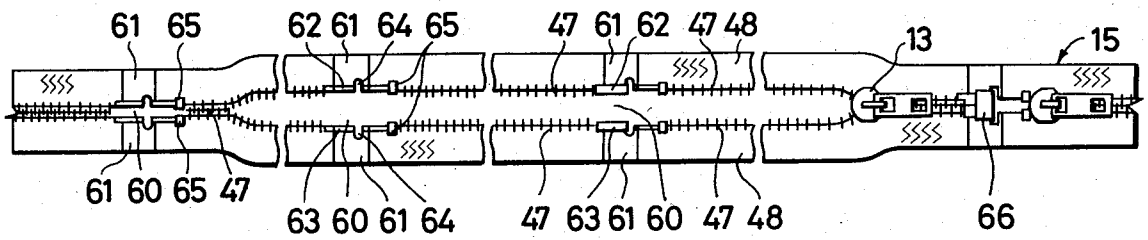
FIG. 6 is a plan view of a slide fastener chain to be fed through the slider applicator.

FIG. 6 shows the slide fastener chain 15 in greater detail. The slide fastener chain 15 has element-free spaces 60 alternating with the rows of coupling elements 47 in the longitudinal direction of the slide fastener chain 15. The slide fastener chain 15 also includes reinforcing films 61 of synthetic resin applied to the slide fastener stringers 48, 48 adjacent to the element-free spaces 60. Box and insertion pins 62, 63 are attached to the respective inner edges of the slide fastener stringers 48, 48 in the element-free spaces 60, the box and insertion pins 62, 63 being held against the endmost coupling elements 47, 47 as better shown in FIGS. 7A through 7C. The reinforcing films 61 have recesses 64 opening into the element-free spaces 60 for allowing the box and insertion pins 62, 63 to pass smoothly through the slider 13 when the slider 13 is applied to the slide fastener chain 15. End stops 65 are also mounted on the inner edges of the slide fastener stringers 48, 48 at the ends of the coupling element rows 47 adjacent to the element-free spaces 60.

Figure 4:
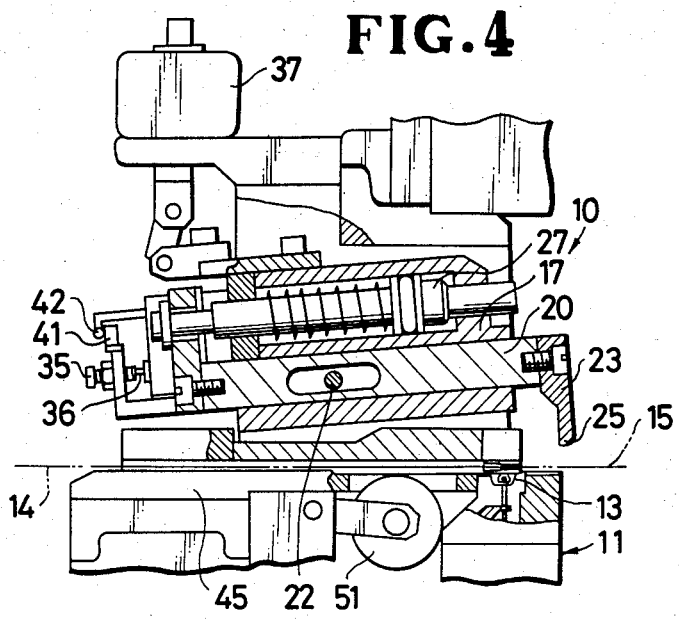
FIG. 4 is a view similar to FIG. 2, illustrating the stopper retracted to its inoperative position.

Operation of the slider applying apparatus 10 is as follows:

The slide fastener chain 15 is fed along the feed path 14 through the slider applying apparatus 10 by the feed roller assembly 16. In the slider applying apparatus 10, the slide fastener stringers 48, 48 are separated from each other as shown in FIG. 6. When one of the element-free spaces 60 reaches the curved portions 49, 49 of the guide grooves 46, 46 (FIG. 5), the sensor rollers 51, 51 are moved upwardly into the curved portions 49, 49, respectively. The microswitch 55 is now actuated by the vertical arm 54 of the lever 53 to raise the slider holder 11 until the slider 13 supported thereon is placed in the element-free space 60. At the same time, the air cylinder 37 is actuated by the microswitch 55 to move the casing 17 pivotably until the stopper 23 is positioned in the feed path 14 behind the leading end of the slider 13, as shown in FIG. 2. The lower end 25 of the stopper 23 is now disposed on the upper surfaces of the inner edges of the slide fastener stringers 48, 48 across the element-free space 60. As the slide fastener chain 15 is continuously fed to the right (FIG. 2) along the feed path 14, the leading ends of the box and insertion pins 62, 63 are moved through the Y-shaped guide channel of the slider 13 into abutment against the lower stopper end 25. Continued travel of the slide fastener chain 15 causes the pins 62, 63 to push the stopper 23 to the right as shown in FIG. 3. The slide rod 20 is slidably moved to the right to cause the piston 27 to be moved also to the right, while permitting air under pressure to leak gradually from the first chamber 29 to the second chamber 30 across the piston 27. The pusher 35 on the L-shaped arm 34 fixed to the slide rod 20 then actuates the microswitch 36 which actuates the air cylinder 37 to tilt the casing 17 in the direction to lift the lower stopper end 25 out of the feed path 14, as shown in FIG. 4. The stopper 23 is now retracted upwardly to its inoperative position to allow the box and insertion pins 62, 63 to pass beyond the stopper 23. As the slide fastener chain 15 travels further downstream, the coupling elements 47, 47 are progressively intermeshed in the Y-shaped guide channel of the slider 13. The slider locking lever 57 is then turned counterclockwise (FIG. 2) out of engagement with the slider pull tab 58 by the spindle rod 59 to release the slider 13. The slider holder 11 is now lowered to leave the slider 13 carried on the slide fastener chain 15 and also to hold a new slider. After the slider 13 has been mounted on the slide fastener chain 15, a box 66 is attached to the box pin 62 for insertion of the insertion pin 63 therein.

Insofar as the box and insertion pins 62, 63 are properly attached to the stringers 48, 48 in alignment with each other, the above cycle of operation is automatically repeated to apply sliders successively to the slide fastener chain 15. The slide fastener chain 15 discharged from the slider applying apparatus 10 is cut off to produce individual separable slide fasteners or remains uncut so as to be supplied as an elongate slide fastener chain product.

Figure 7A:
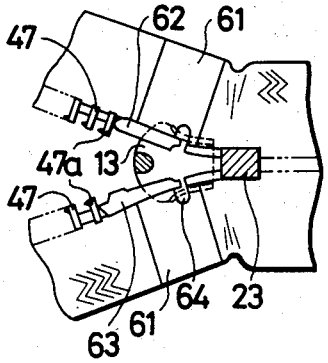
FIGS. 7A through 7C are fragmentary plan views showing the manner in which the stopper is displaced by box and insertion pins attached properly to stringer tapes.
Figure 7B:
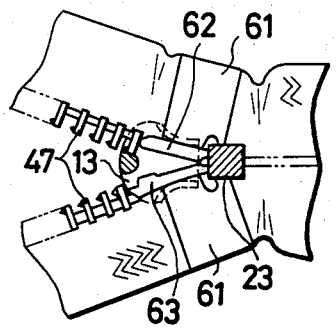
Figure 7C:
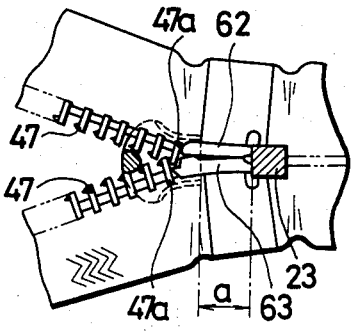

FIGS. 7A through 7C show the manner in which the properly aligned box and insertion pins 62, 63 are progressively inserted into and through the slider 13. As illustrated in FIG. 7A, the aligned box and insertion pins 62, 63 are held in contact with the endmost coupling elements, denoted at **47*a*, 47*a*. The pins 62, 63 enter the slider 13 as the coupling element rows 47, 27 are guided through the guide grooves 46, 46 (FIG. 5). The leading ends of the pins 62, 63 are then brought against the stopper 23 as shown in FIG. 7B. The stopper 23 is pushed by the slide fastener chain 14 as it is continuously fed along the feed path 14 until the stopper 23 is moved downstream by a distance a as illustrated in FIG. 7C. The distance a is selected such that while the stopper 13 traverses the distance a, the endmost coupling elements 47*a*, 47*a* are intermeshed, and that after the stopper 23 has moved the distance a, the pusher 35 engages the microswitch 36 to actuate the same. Since the endmost coupling elements 47*a*, 47*a* can be interengaged only when the pins 62, 63 are properly mounted on the slide fastener stringers 48, 48, the actuation of the microswitch 34 gives an indication of the proper alignment of the pins 62, 63 attached to the slide fastener stringers 48, 48. As the slide rod 20 moves downstream, the sensing plate 41 is also displaced across the sensor switch 42. However, as long as the endmost coupling elements 47*a*, 47*a* are properly intermeshed and hence the pins 62, 63 are properly positioned, the sensing plate 41 moves past the sensor switch 42 within a time period shorter than the prescribed time interval selected to enable the sensor switch 42 to issue a signal to stop the feed roller assembly 16. Consequently, no signal is generated by the sensor switch 42** at this time.

Figure 8A:
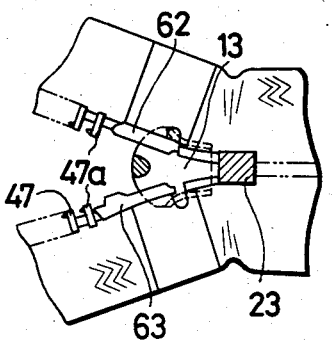
FIGS. 8A through 8C are fragmentary plan views showing the manner in which the stopper is displaced by box and insertion pins attached improperly to stringer tapes.
Figure 8B:
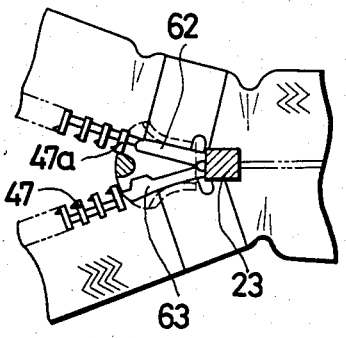
Figure 8C:
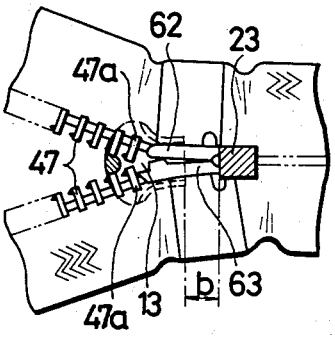

FIGS. 8A through 8C show the manner in which the improperly attached or misaligned box and insertion pins 62, 63 are progressively inserted into the slider 13. As shown in FIG. 8A, the box pin 62 is displaced away from the endmost coupling element **47*a*. When the misaligned box and insertion pins 62, 63 are inserted into the slider 13 as shown in FIG. 8B, and held against the stopper 23 as shown in FIG. 8C, the endmost coupling elements 47*a*, 47*a* hit each other head on and cannot be intermeshed. The endmost coupling elements 47*a*, 47*a* are therefore stuck in the slider 13, and the stopper 23 is stopped only after it has moved a distance b shorter than the distance a. The pusher 35 is also stopped short of engagement with the microswitch 36. The sensing plate 41 now remains positioned alongside of the sensor switch 42 for a time period longer than the prescribed time interval, thereby enabling the sensor switch 42 to issue a signal to stop the feed roller assembly 16. At the same time, the sensor switch 42 energizes the pilot lamp to signal the improper attachment of the box pin 62. When the insertion pin 63 is improperly positioned on the slide fastener stringer 48, the feed roller assembly 16 is also stopped and the pilot lamp is also energized since the endmost coupling elements 47*a*, 47*a*** fail to mesh with each other.

In the event that only one of the box and insertion pins 62, 63 abut against the stopper 23 due to different rates of elongation of the slide fastener stringers 48, 48, the stopper 23 remains stopped since the forces from one of the box and insertion pins 62, 63 is not strong enough to displace the stopper 23 against the forces of the damper 67. Therefore, the stopper 23 is prevented from moving downstream by the damper 67, or the air pressure in the first chamber 29 in the cylinder bore 26. When the box and insertion pins 62, 63 abut against the stopper 23 at the same time, the stopper 23 is displaced downward under the combined forces from the pins 62, 63 while overcoming the resistive forces from the damper 67. The slide rod 20 is then caused by the slide fastener chain 15 to move downstream until the pusher 35 engages the microswitch 36 in the manner described above. The slider 13 can now be mounted on the slide fastener chain 15.

Although there is no illustrative example here, if one of the box and insertion pins 62, 63 has been positioned on the fastener stringer 48 in a tilted state with respect to its inner longitudinal edge, or has been inadvertently omitted from the fastener stringer 48, the stopper 23 also remains at rest when it is hit by the other pin 63, 62, since the forces derived from the latter are not strong enough to displace the stopper 23 against the forces of the damper 67.

Although various minor modifications may be suggested by those versed in the art, it should be understood that we wish to embody within the scope of the patent warranted hereon, all such embodiments as reasonably and properly come within the scope of our contribution to the art.

What is claimed is:

1. An apparatus for applying a slider to a separable slide fastener chain composed of a pair of slide fastener stringers having a box pin and an insertion pin, respectively, on inner confronting edges thereof, said apparatus comprising:

(a) a base;

(b) a slider holder mounted on said base for supporting the slider between the slide fastener stringers;

(c) a support block mounted on said base;

(d) a casing pivotably mounted on said support block;

(e) a slide rod slidably mounted in said casing for movement substantially along said slide fastener chain;

(f) a stopper mounted on said slide rod and normally positioned adjacent to a slider supporting end of said slider holder for engagement with said box pin and said insertion pin;

(g) a damper mounted in said casing and coupled to said slide rod for allowing said stopper to be displaced for a prescribed distance by both of said box and insertion pins;

(h) actuator means on said support block for angularly moving said casing to displace said stopper out of engagement with said box pin and said insertion pin;

(i) switch means mounted on said casing and said slide rod for actuating said means to displace said stopper out of engagement with said box pin and said insertion pin in response to displacement of said stopper for said prescribed distance; and (j) sensor means mounted on said casing and said slide rod for signalling improper positioning of at least one of said box and insertion pins in response to displacement of said stopper short of said prescribed distance.

2. An apparatus according to claim 1, said damper comprising a cylinder bore defined in said casing, a piston slidably disposed in said cylinder bore for movement substantially parallel to said slide rod, said piston dividing said cylinder bore into two chambers filled with air under pressure, and a spring disposed in one of said chambers, said piston and said slide rod being coupled to each other.

3. An apparatus according to claim 1, including a housing mounted on said support block and accommodating said casing therein, said actuator means comprising an air cylinder supported on said housing and a linkage operatively connected between said casing and said air cylinder.

4. An apparatus according to claim 1, said switch means comprising a pusher attached to said slide rod and a microswitch supported on said casing and electrically connected to said actuator means, said microswitch being engageable by said pusher when said stopper is moved for said prescribed distance by said box and insertion pins.

5. An apparatus according to claim 1, said sensor means comprising a sensing plate connected to said slide rod and a sensor switch supported on said casing for issuing a signal when the sensor switch is actuated by said sensing plate for a period of time in which said stopper remains displaced short of said prescribed distance.

6. An apparatus according to claim 1, further including a feed roller assembly for feeding said slide fastener chain through said slider, said feed roller assembly being inactivatable in response to a signal from said sensor means.

* * * * *